US012653331B2

(12) United States Patent
Vallee

(10) Patent No.: US 12,653,331 B2
(45) Date of Patent: Jun. 16, 2026

(54) REFRIGERATED DISPLAY CABINET

(71) Applicant: Carrier Corporation, Palm Beach Gardens, FL (US)

(72) Inventor: Christophe Vallee, Mainz-Kostheim (DE)

(73) Assignee: CARRIER CORPORATION, Palm Beach Gardens, FL (US)

( * ) Notice: Subject to any disclaimer, the term of this patent is extended or adjusted under 35 U.S.C. 154(b) by 47 days.

(21) Appl. No.: 18/639,091

(22) Filed: Apr. 18, 2024

(65) Prior Publication Data

US 2024/0349912 A1 Oct. 24, 2024

Related U.S. Application Data

(60) Provisional application No. 63/497,541, filed on Apr. 21, 2023.

(51) Int. Cl.
*A47F 3/04* (2006.01)

(52) U.S. Cl.
CPC ..... *A47F 3/0482* (2013.01); *A47F 3/0408* (2013.01); *A47F 3/0443* (2013.01); *A47F 3/0447* (2013.01)

(58) Field of Classification Search
CPC .... A47F 3/0408; A47F 3/0443; A47F 3/0447; A47F 3/0482; A47F 3/0426; A47F 3/0469
See application file for complete search history.

(56) References Cited

U.S. PATENT DOCUMENTS 1,709,730 A * 4/1929 Mcleish ..... F25D 21/14 62/290
2,667,041 A * 1/1954 Henderson ..... F25D 21/14 62/515
5,402,656 A 4/1995 Jaster et al.
(Continued)

FOREIGN PATENT DOCUMENTS

CA 2630963 A1 5/2007
EP 1522238 A1 4/2005
(Continued)

OTHER PUBLICATIONS

European Search Report for Application No. 24171439.3, Issued Sep. 9, 2024, 10 Pages.
(Continued)

*Primary Examiner* — Andrew Roersma
(74) *Attorney, Agent, or Firm* — CANTOR COLBURN LLP

(57) ABSTRACT

A refrigerated display cabinet is disclosed. The cabinet comprises a case comprising one or more shelves disposed between side walls of the case to form a conservation space to support and store one or more products therewithin, a duct extending from a bottom front side of the cabinet to a top front side of the cabinet via a rear side of the cabinet, and at least one heat exchanger comprising one or more headers, and a plurality of flat microchannel tubes, wherein the at least one heat exchanger is disposed within the duct on the rear side of the cabinet with the plurality of flat microchannel tubes inclined at a first predefined angle with respect to a horizontal plane such that the headers on both sides of the flat microchannels tubes are at different elevations.

12 Claims, 7 Drawing Sheets

(56) References Cited

U.S. PATENT DOCUMENTS

| | | | | |
|---|---|---|---|---|
| 5,531,268 | A | 7/1996 | Hoshino et al. | |
| 7,028,764 | B2 | 4/2006 | Reagen | |
| 7,062,932 | B2 * | 6/2006 | Downs | A47F 3/0447 454/193 |
| 8,359,876 | B2 * | 1/2013 | Esformes | F25B 39/022 62/515 |
| 8,739,855 | B2 | 6/2014 | Fritz et al. | |
| 12,349,815 | B2 * | 7/2025 | Bates | A47F 3/0408 |
| 2004/0168456 | A1 | 9/2004 | Chiang et al. | |
| 2005/0132744 | A1 * | 6/2005 | Rohrer | F28F 9/0273 62/515 |
| 2006/0144076 | A1 * | 7/2006 | Daddis | F28F 1/32 62/440 |
| 2010/0011795 | A1 * | 1/2010 | Stokke | F28F 17/005 165/47 |
| 2013/0019621 | A1 * | 1/2013 | Wood | A47F 3/0447 62/126 |
| 2013/0213073 | A1 | 8/2013 | Fritz et al. | |
| 2017/0276433 | A1 | 9/2017 | Avila et al. | |
| 2017/0356700 | A1 | 12/2017 | Joardar | |
| 2018/0142957 | A1 | 5/2018 | Laurentius | |
| 2020/0352356 | A1 * | 11/2020 | Joardar | A47F 3/0491 |
| 2020/0352359 | A1 * | 11/2020 | Joardar | A47F 3/0447 |
| 2024/0349911 | A1 | 10/2024 | Vallee | |

FOREIGN PATENT DOCUMENTS

| | | | | |
|---|---|---|---|---|
| EP | 3863011 | A1 * | 8/2021 | A47F 3/0469 |
| KR | 102285129 | B1 * | 8/2021 | F25D 17/06 |
| WO | WO-2017108102 | A1 * | 6/2017 | A47F 3/0443 |

OTHER PUBLICATIONS

European Search Report for Application No. 24171452.6, Issued Sep. 9, 2024, 10 Pages.

* cited by examiner

REFRIGERATED DISPLAY CABINET

CROSS-REFERENCE TO RELATED APPLICATION

This patent application claims the benefit of U.S. Provisional Patent Application No. 63/497,541, filed on Apr. 21, 2023, which is incorporated by reference herein in its entirety.

BACKGROUND

This invention relates to the field of refrigerated display cabinets.

Refrigerated display cabinets include a heat exchanger (evaporator) that may facilitate the cooling of a conservation space associated with the cabinet. Existing refrigerated display cabinets may include a heat exchanger having different bent shapes for improved heat transfer performance and cooling, however, the bent-shaped heat exchangers may be expensive, bulky, difficult to install, and may have other limitations and drawbacks. There is, therefore, a need to improve the existing refrigerated display cabinets.

SUMMARY

Described herein is a refrigerated display cabinet. The cabinet comprises a case comprising one or more shelves disposed between side walls of the case to form a conservation space to support and store one or more products therewithin, a duct extending from a bottom front side of the cabinet to a top front side of the cabinet via a rear side of the cabinet, and at least one heat exchanger comprising one or more headers, and a plurality of flat microchannel tubes, wherein the at least one heat exchanger is disposed within the duct on the rear side of the cabinet with the plurality of flat microchannel tubes inclined at a first predefined angle with respect to a horizontal plane such that the headers on both sides of the flat microchannel tubes are at different elevations.

In one or more embodiments, the first predefined angle is at least 10° to 15° to the horizontal plane.

In one or more embodiments, the duct comprises a bottom airflow zone extending along the bottom side of the cabinet, a rear airflow zone upstream of the bottom airflow zone and extending on the rear side of the cabinet, and a top airflow zone upstream of the rear airflow zone and extending along the top side of the cabinet.

In one or more embodiments, the at least one heat exchanger comprises a first header and a second header disposed at a left side and a right side of the rear airflow zone respectively, and extending longitudinally between a front end and a rear end of the rear airflow zone, wherein the plurality of flat microchannel tubes fluidically connect the first header and the second header.

In one or more embodiments, the first header and the second header are oriented parallel to the horizontal plane.

In one or more embodiments, the first header and the second header are oriented at a second predefined angle from the horizontal plane.

In one or more embodiments, the at least one heat exchanger comprises a plurality of fins extending between at least some of the plurality of flat microchannel tubes.

In one or more embodiments, the plurality of fins extending between at least some of the plurality of flat microchannel tubes is louvered such that a louvered airflow path is formed between the adjacent louvers.

In one or more embodiments, the cabinet is any of an open-front type display cabinet, or a door-type display cabinet comprising one or more doors movably coupled to a front end of the case.

In one or more embodiments, the cabinet comprises at least one fan positioned upstream or downstream of the at least one heat exchanger within the duct, wherein the at least one fan is configured to facilitate the inflow of air within the duct through the bottom front side of the cabinet, pass the received air through the at least one heat exchanger to cool the received air, and pump out the cool air from the top front side of the cabinet, and wherein the cool air pumped out by the top front side of the cabinet is received by the bottom front side of the cabinet such that an aerothermodynamic barrier or air curtain is formed in front of the one or more shelves or behind the doors of the cabinet.

In one or more embodiments, the top front side of the duct is configured with a discharge air grille (DAG) and the bottom front side of the duct is configured with a return air grille (RAG), wherein the DAG and the RAG control the air directivity and facilitate the creation of the air curtain in front of the one or more shelves or behind the doors of the cabinet.

In one or more embodiments, the cabinet comprises a perforated wall panel (PWP) configured with the duct on the rear side of the cabinet and the PWP is configured to discharge a portion of cool air passing through the duct in the conservation space to maintain the predefined temperature therewithin.

In one or more embodiments, the heat exchanger is disposed within the rear airflow zone such that the heat exchanger remains at least partially below a bottom most shelf among the one or more shelves in order to discharge a portion of the cool air through the air perforated wall panel (PWP) to the conservation space below the bottom most shelf and above the bottom airflow zone.

Also described herein is a heat exchanger for a refrigerated display cabinet. The heat exchanger comprises a first header and a second header disposed within a rear side of a duct associated with the cabinet, wherein the duct extends from a bottom front side of the cabinet to a top front side of the cabinet via the rear side of the cabinet, and a plurality of flat microchannel tubes extending parallelly between and fluidically connecting the first header and the second header, wherein the plurality of flat microchannel tubes are inclined at a first predefined angle with respect to a horizontal plane such that the first header and the second header on both sides of the flat microchannel tubes are at different elevations.

In one or more embodiments, the first predefined angle is at least of 10° to 15° to the horizontal plane.

In one or more embodiments, the heat exchanger comprises a plurality of louvered fins extending between at least some of the plurality of flat microchannel tubes such that a louvered airflow path is formed between the adjacent louvers.

In one or more embodiments, the first header and the second header are disposed at a left side and a right side, respectively, within a rear airflow zone associated with the duct on the rear side of the cabinet, such that the first header and the second header extend longitudinally between a front end and a rear end of the rear airflow zone.

In one or more embodiments, the first header and the second header are oriented parallel to the horizontal plane and are positioned at different elevations.

In one or more embodiments, the first header and the second header are positioned at different elevations and simultaneously oriented at a second predefined angle from the horizontal plane.

Further described herein is a refrigerated display cabinet. The cabinet comprises a case comprising one or more shelves extending between side walls of the case to form a conservation space to support and store one or more products therewithin, a duct extending from a bottom front side of the cabinet to a top front side of the cabinet via a rear side of the cabinet, and at least one heat exchanger comprising one or more headers, a plurality of flat microchannel tubes, and louvered fins disposed between at least some of the plurality of flat microchannel tubes such that a louvered airflow path is formed between the adjacent louvers. The at least one heat exchanger is disposed within the duct on the rear side of the cabinet with the plurality of flat microchannel tubes inclined at a first predefined angle with respect to a horizontal plane such that the headers on both sides of the flat microchannel tubes are at different elevations.

The foregoing summary is illustrative only and is not intended to be in any way limiting. In addition to the illustrative aspects, embodiments, and features described above, further aspects, embodiments, features, and techniques of the subject disclosure will become more apparent from the following description taken in conjunction with the drawings.

BRIEF DESCRIPTION OF THE DRAWINGS

The accompanying drawings are included to provide a further understanding of the subject disclosure and are incorporated in and constitute a part of this specification. The drawings illustrate exemplary embodiments of the subject disclosure and, together with the description, serve to explain the principles of the subject disclosure.

In the drawings, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

DETAILED DESCRIPTION

Figure 1A:
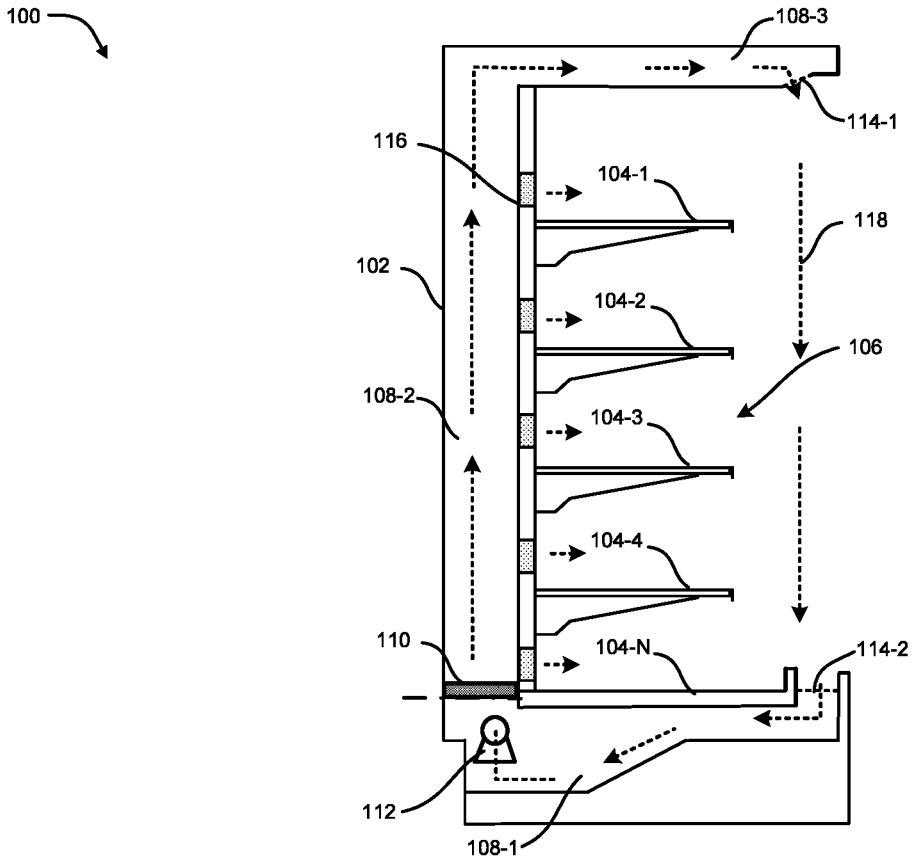
FIG. 1A is a schematic diagram illustrating a sectional view from the side of an open-type vertical refrigerated display cabinet where the headers of the heat exchanger are horizontally oriented in accordance with one or more embodiments of the subject disclosure.

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the subject disclosure as defined by the appended claims.

Various terms are used herein. To the extent a term used in a claim is not defined below, it should be given the broadest definition persons in the pertinent art have given that term as reflected in printed publications and issued patents at the time of filing.

In the specification, reference may be made to the spatial relationships between various components and to the spatial orientation of various aspects of components as the devices are depicted in the attached drawings. However, as will be recognized by those skilled in the art after a complete reading of the subject disclosure, the components of this invention described herein may be positioned in any desired orientation. Thus, the use of terms such as "above," "below," "upper," "lower," "first", "second" or other like terms to describe a spatial relationship between various components or to describe the spatial orientation of aspects of such components should be understood to describe a relative relationship between the components or a spatial orientation of aspects of such components, respectively, as the heat exchanger, flat microchannel tubes, heat dissipating fins, shelves, and corresponding components of the refrigerated cabinet, described herein may be oriented in any desired direction. The term "flat microchannel tubes" is employed to describe a heat exchanger having a planar configuration as opposed to a non-planar configuration such as a U shape, V shape, W shape, A shape or the like.

The refrigerated display cabinet "cabinet" includes a heat exchanger (evaporator) installed in an airflow path provided in the cabinet to facilitate cooling of a conservation space associated with the cabinet and keep the stored products or goods conditioned. Existing cabinets may include a microchannel heat exchanger having different bent shapes for improved heat transfer or cooling performance and frost-free operation of the cabinet. However, the existing bent-shaped heat exchangers have space constraints and are expensive, bulky, and difficult to install. There is, therefore, a need to provide improved cooling performance with the frost-free operation and reduced air pressure drop in the cabinet while keeping the heat exchanger and the overall cabinet compact and cost-effective.

This invention provides a compact, improved, and efficient refrigerated cabinet that has improved cooling performance with the frost-free operation and reduced air pressure drop. The cabinet achieves this by employing a microchannel heat exchanger comprising flat microchannel tubes installed within a rear airflow zone on the back side of the cabinet such that the headers associated with the heat exchanger are located on extreme lateral ends (left and right sides) of the rear airflow zone with the flat microchannel tubes extending therebetween. As the microchannel heat exchanger is installed on the rear airflow zone on the back side of the cabinet, the length of the headers may be kept smaller and the face area of the heat exchanger may also be increased compared to designs where the heat exchanger is installed within a bottom airflow zone of the cabinet. As a result, the refrigerant consumption of the microchannel heat exchanger may be reduced and the refrigerant distribution within the flat microchannel tubes in this cabinet may also be improved compared to cabinet designs where the heat exchanger is installed within the bottom airflow zone of the cabinet and involving substantially longer headers. Moreover, the use of flat microchannel tubes in this invention may provide frost-free operation due to their good heat transfer performance compared to existing round tube plate fin heat exchanger.

In addition, the flat microchannel tubes in this invention may be inclined at least by an angle of 10° to 15° to a horizontal plane to enable automated condensate drainage, irrespective of the orientation of the headers. Generally, in existing cabinets, where the flat microchannel tubes are oriented horizontally (0° to the horizontal plane) within the airflow zone, condensate may accumulate in fins or gaps provided between adjacent flat tubes due to dominating capillary forces, which may decrease the cooling capacity and increase the pressure drop in the microchannel heat exchanger. However, as the flat microchannel tubes in this invention may be inclined (by an angle of at least 10° to 15°) to the horizontal plane, the inclined flat microchannel may enable automated drainage of any condensate towards the bottom of the rear airflow zone for further removal or extraction.

Thus, this invention overcomes the limitations, shortcomings, and drawbacks associated with existing cabinets by providing a compact, improved, and efficient refrigerated cabinet that has improved cooling performance with frost-free operation and reduced air pressure drop.

Referring to FIGS. 1A to 4, the refrigerated display cabinet 100 (also referred to as cabinet 100, hereinafter) is disclosed. The cabinet 100 may include a case 102 comprising one or more shelves 104-1 to 104-N (collectively referred to as shelves 104, herein) extending between the side walls 102-1, 102-2 of case 102, thereby forming a conservation space 106 to support and store products or goods therewithin. The cabinet may further include a duct 108 or airflow passage extending from the bottom front side of cabinet 100 to the top front side of cabinet 100 via a rear side of cabinet 100. The duct 108 may include a bottom airflow zone (first section of the duct) 108-1 extending from the bottom front side to the bottom rear side of cabinet 100, a rear airflow zone (second section of the duct) 108-2 extending on the rear side of the cabinet 100 from the bottom rear side to a top rear side of the cabinet 100 and fluidically connected to the bottom airflow zone 108-1, and a top airflow zone (third section of the duct) 108-3 extending from the top rear side to the top front side of the cabinet and fluidically connected the rear airflow zone 108-2.

Figure 1B:
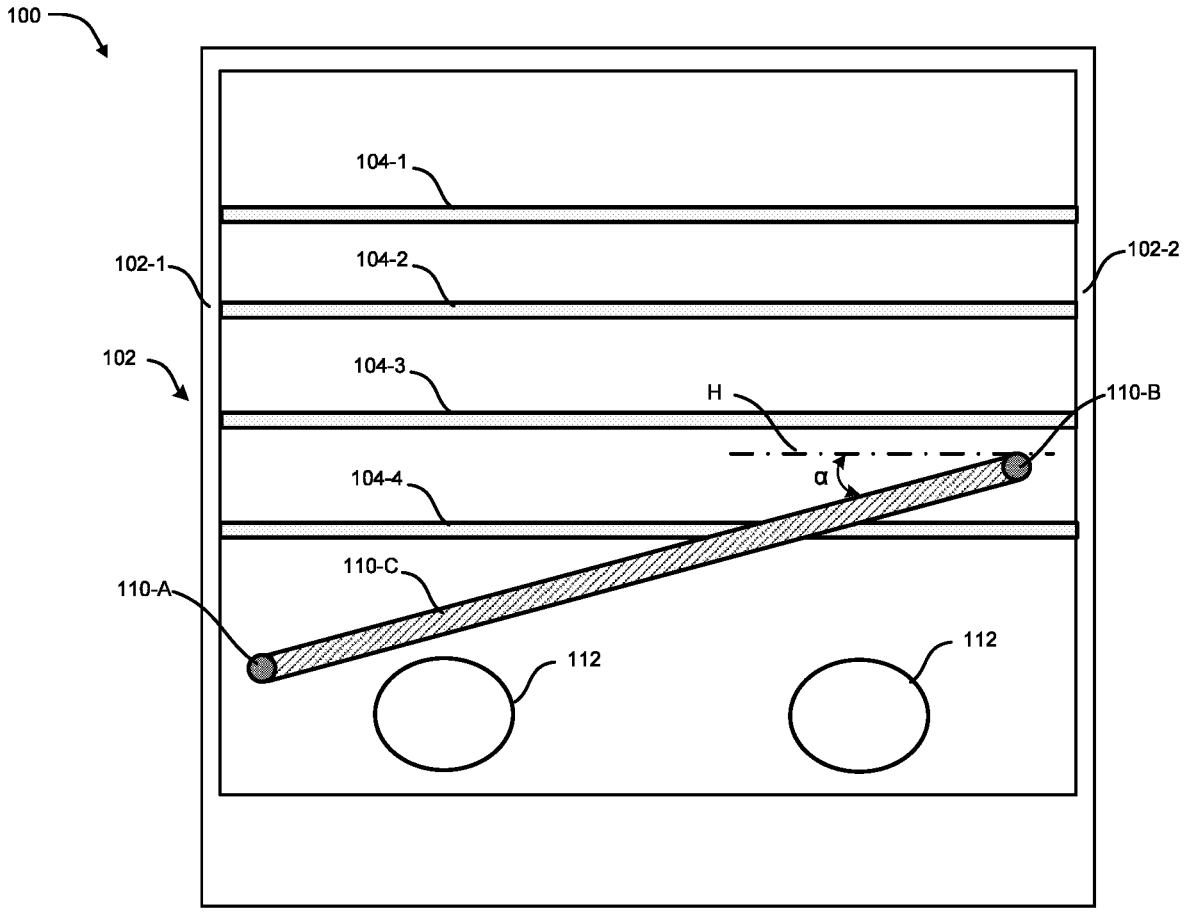
FIGS. 1B and 1C illustrate an exemplary front internal view of the refrigerated display cabinet where the tubes are inclined by a first predefined angle on the left side and right side, respectively, in accordance with one or more embodiments of the subject disclosure.
Figure 1C:
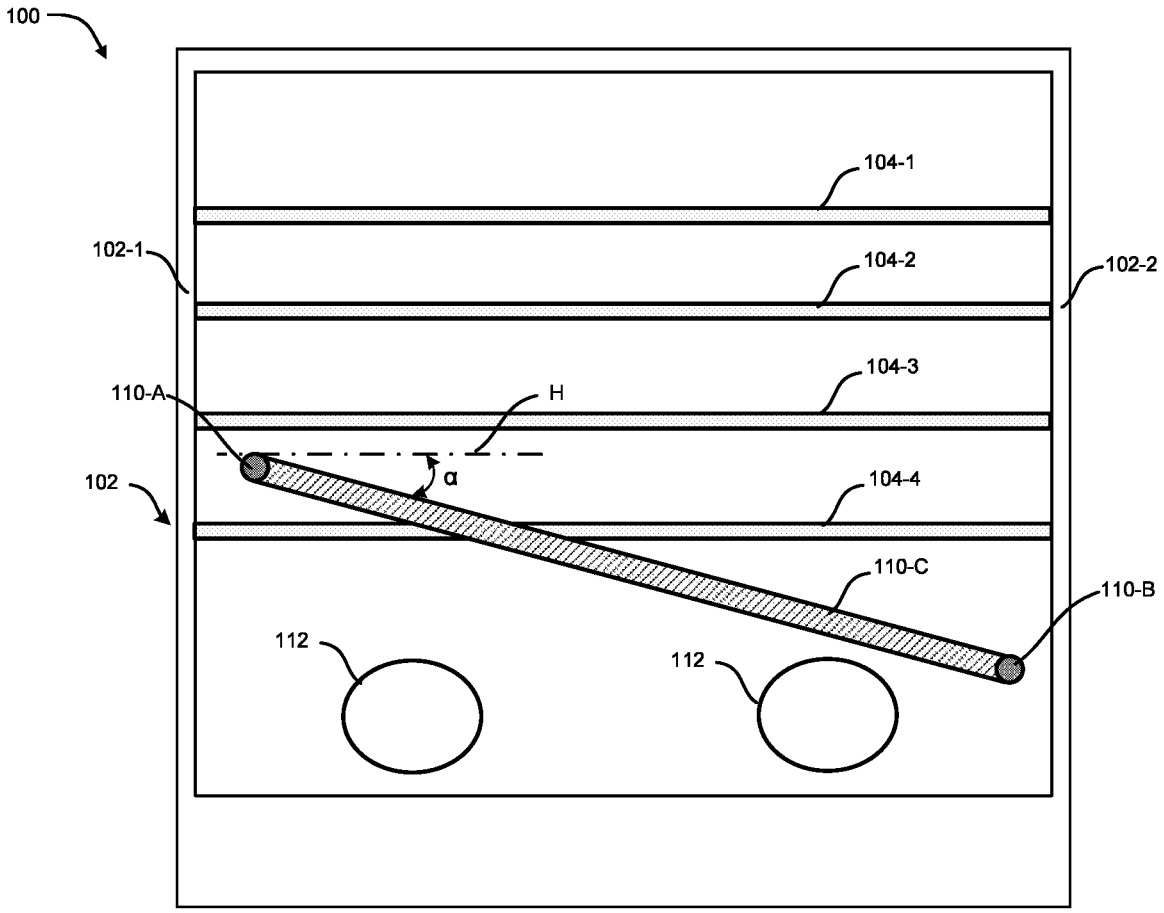
Figure 1D:
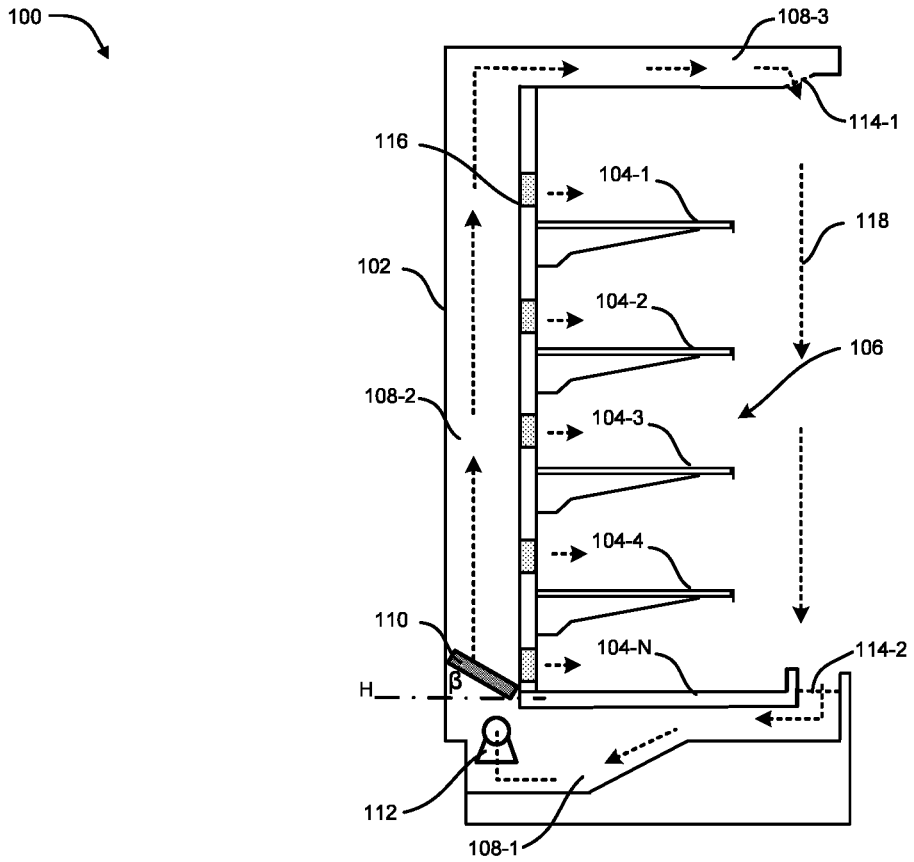
FIG. 1D is a schematic diagram illustrating a sectional view from the side of an open-type vertical refrigerated display cabinet where the headers of the heat exchanger are inclined by a second predefined angle from horizontal plane in accordance with one or more embodiments of the subject disclosure
Figure 2:
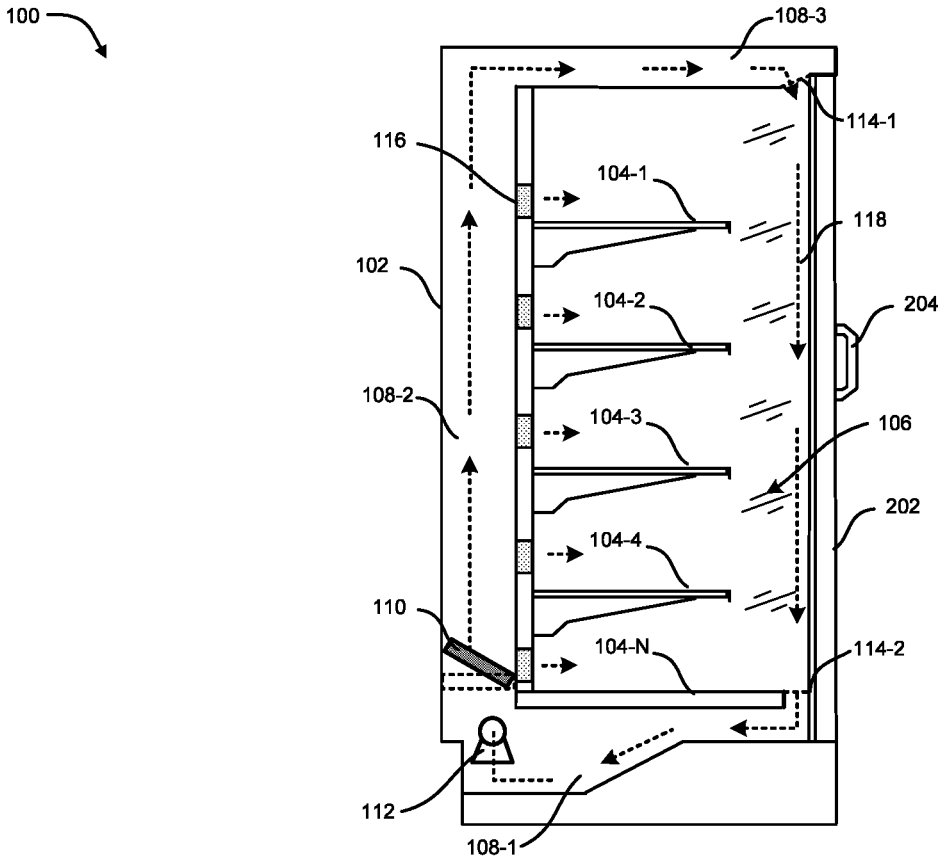
FIG. 2 is a schematic diagram illustrating a sectional view from the side of a door-type vertical refrigerated display cabinet in accordance with one or more embodiments of the subject disclosure
Figure 3:
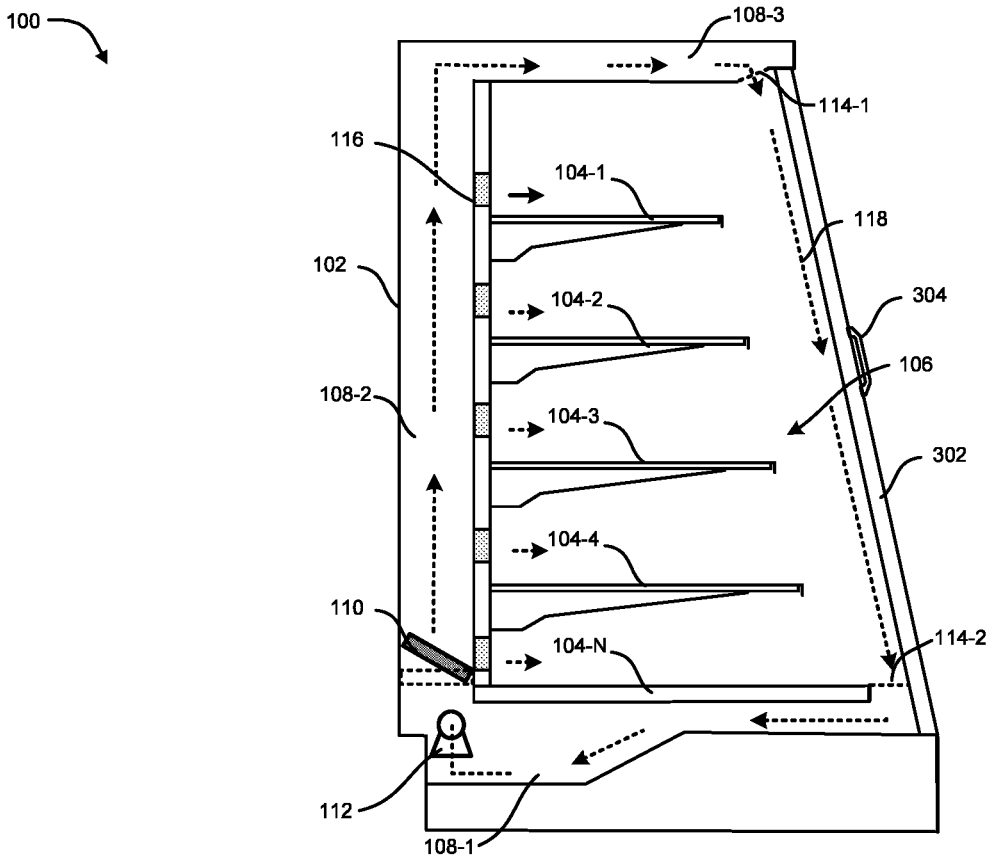
FIG. 3 is a schematic diagram illustrating a sectional view from the side of a door-type semi-vertical refrigerated display cabinet with flat doors in accordance with one or more embodiments of the subject disclosure.
Figure 4:
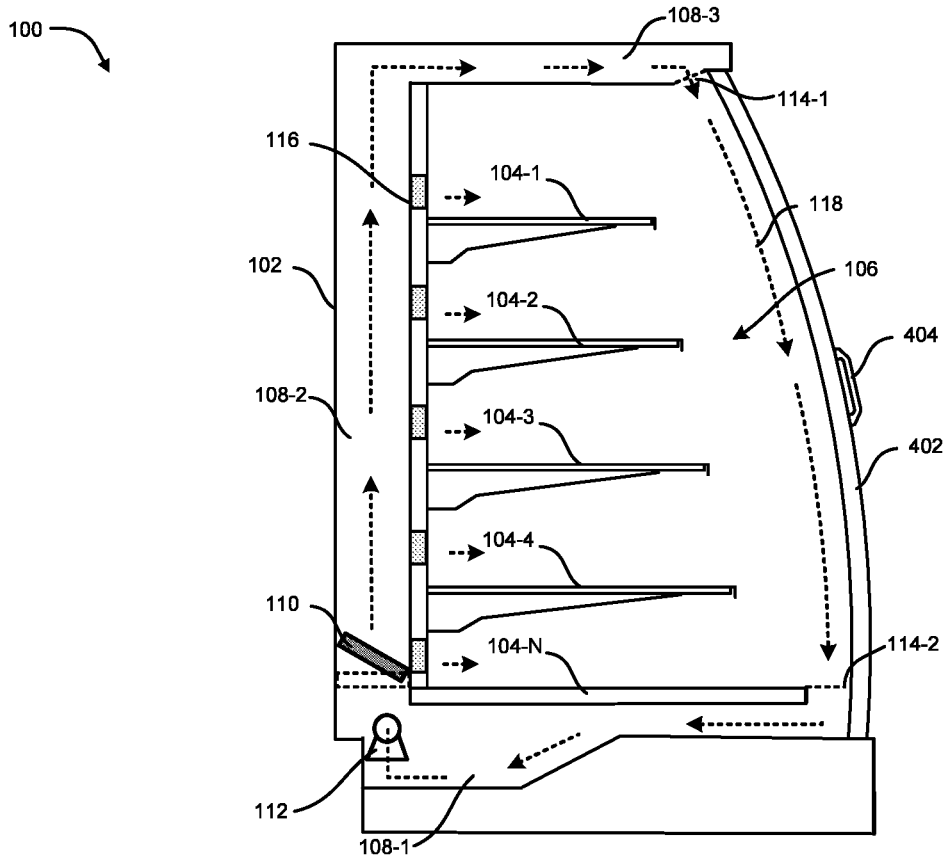
FIG. 4 is a schematic diagram illustrating a sectional view from the side of a door-type semi-vertical refrigerated display cabinet with curved doors in accordance with one or more embodiments of the subject disclosure.

In one or more embodiments, the cabinet 100 may be an open-type cabinet 100 (without any doors) as shown in FIGS. 1A and 1D where an aerothermodynamic barrier may be created in front of cabinet 100 by a recirculating air curtain 118 that may keep the conservation space 106 and the environment thermally isolated. In other embodiments, the cabinet 100 may be a door-type cabinet 100 as shown in FIG. 2 to 4 which may include multiple doors (collectively referred to as doors, herein) movably coupled to the front of case 102. The doors may be adapted to move between an open position and a closed position. The doors and/or the aerothermodynamic barrier created in front of the cabinet 100 by a recirculating air curtain 118 may keep the conservation space 106 and the environment thermally isolated In an embodiment, the cabinet 100 may include a refrigeration system or cooling unit to maintain a predefined temperature in the conservation space 106 of cabinet 100 and also create a recirculating air curtain 118 in front of the shelves 104 or behind the doors of the cabinet 100 in order to create an aerothermodynamic barrier between the conservation space 106 and environment. The refrigeration system may involve duct 108 extending from the bottom front side of the cabinet 100 to the top front side of the cabinet 100 via the rear side of the cabinet 100. Further, an opening of the top front side of duct 108 may be configured with a discharge air grille (DAG) 114-1 and an opening of the bottom front side of duct 108 may be configured with a return air grille (RAG) 114-2. The DAG 114-1 and the RAG 114-2 may control air directivity and facilitate the creation of the air curtain 118 in front of the shelves 104 or behind the doors of the cabinet 100. The DAG 114-1 and RAG 114-2 may further restrict the entry of undesired objects within duct 108. As illustrated, the bottom airflow zone 108-1 (first section) of duct 108 may extend horizontally from RAG 114-2 to the bottom rear side of the cabinet 100, the rear airflow zone 108-2 (second section) of duct 108 may extend vertically from the bottom rear side to the top rear side of the cabinet 100, and the top airflow zone 108-3 (third section) of the duct 108 may extend horizontally from the top rear side to the DAG 114-1.

The refrigeration system may further include an evaporator comprising a heat exchanger 110 that may include a plurality of flat microchannel tubes 110-C disposed within duct 108. The evaporator/heat exchanger 110 may be operable to enable heat exchange between the cool refrigerant and incoming air stream entering within duct 108 to cool the air to a predefined temperature, which may be supplied to the conservation space 106 and/or create the cool air curtain 118 in front of the shelves 104. In one or more embodiments, the heat exchanger 110 may be disposed within the rear airflow zone 108-2 of duct 108 such that the plurality of flat microchannel tubes 110-C is inclined at a first predefined angle ($\alpha$) with respect to a horizontal plane (H). In one or more implementations, the first predefined angle may be at least of 10° to 15°. The heat exchanger 110 may further include a first header 110-A and a second header 110-B disposed at a left side and a right side of the heat exchanger which may extend across the rear air flow zone 108-2 so that the first header 110-A and the second header 110-B are disposed adjacent to left side wall 102-1 and right side wall 102-2 of the rear airflow zone 108-2. and the first header 110-A and the second header 110-B extend longitudinally between a front end and a rear end of the rear airflow zone 108-2, with the plurality of flat microchannel tubes 110-C fluidically connecting the first header 110-A and the second header 110-B. In addition, in one or more embodiments, the heat exchanger 110 may comprise a plurality of fins or louvered fins (not shown) extending between at least some of the plurality of flat microchannel tubes 110-C such that a louvered airflow path or an inter-louver gap is formed between the adjacent louvers, where the condensate may drain through the louvered airflow path.

In one or more embodiments, the first header 110-A and the second header 110-B may be positioned at different elevations within the rear airflow zone 108-2. For instance, as shown in FIG. 1B, the first header 110-A (adjacent to left side wall 102-1) may be at a lower elevation from the second header 110-B (adjacent to right side wall 102-2) such that the plurality of flat microchannel tubes 110-C remains inclined at the first predefined angle (α) from the horizontal plane H on the right side of case 102. In other instances, as shown in FIG. 1C, the first header 110-A (adjacent to left side wall 102-1) may be at a higher elevation compared to the second header 110-B (adjacent to right side wall 102-2) such that the plurality of flat microchannel tubes 110-C remains inclined at the first predefined angle from the horizontal plane on the left side of case 102.

As shown in FIG. 1A, the first header 110-A and the second header 110-B may be oriented parallel to the horizontal plane such that the first header 110-A and the second header 110-B (as shown in side sectional view FIG. 1A) may extend longitudinally between a front end and a rear end of the rear airflow zone 108-2 while the plurality of flat microchannel tubes 110-C remains inclined at the first predefined angle from the horizontal plane H. However, in other embodiments, as shown in side sectional view FIG. 1D, the first header 110-A and the second header 110-B may also be oriented at a second predefined angle (0) from the horizontal plane H but with the plurality of flat microchannel tubes 110-C remaining inclined at the first predefined angle from the horizontal plane. The second predefined angle (p) may be in a range of 10° to 75° to the horizontal plane H, but is not limited to the like.

In one or more embodiments, the heat exchanger 110 may be disposed within the rear airflow zone 108-2 such that the heat exchanger 110 remains at least partially below a bottom-most shelf 104-N among the shelves 104-1 to 104-N. However, the heat exchanger 110 may also be disposed of at any other position in the rear airflow zone 108-2 of the cabinet 100, without any limitation.

Further, the refrigeration system may include a fan 112 that may be positioned adjacent (upstream or downstream) to the heat exchanger 110 within duct 108. The fan 112 may be configured to facilitate the inflow of air within duct 108 through the RAG 114-2, pass the received air through the flat microchannel tubes 110-C of the heat exchanger 110 that cools the received air, and pump out the cool air from the DAG 114-1 of the cabinet 100. Accordingly, the cool air pumped out by the DAG 114-1 (on the top front side of cabinet 100) may be received by the RAG 114-2 (on the bottom front side of cabinet 100) to create a curtain 118 of cool air in front of the shelves 104 or behind the doors of the cabinet 100, which acts as an aerothermodynamic barrier between the conservation space 106 and environment. In addition, the rear airflow zone 108-2 on the rear side of cabinet 100 may include perforated wall panels (PWP) 116 behind the shelves 104, which may discharge a portion of the cool air, passing through duct 108, into the conservation space 106 to maintain the predefined temperature within the cabinet 100. It would be obvious to understand that the number of PWPs 116 used in cabinet 100 can be selected based on the number of shelves 104, and the size and cooling capacity required in the cabinet 100.

The evaporator or heat exchanger 110 associated with the refrigeration system of cabinet 100 may be disposed in the rear airflow zone 108-2 of cabinet 100 with the plurality of flat microchannel tubes 110-C inclined at the first predefined angle (at least 10° to 15° angle) with respect to a horizontal plane as described in detail in above paragraphs. Additional components of the refrigeration system, such as a compressor, a condenser, an expansion device, and the like (not shown) may be installed in any of the rear airflow zone 108-2, or the bottom airflow zone 108-1 of the duct 108 or below the cabinet 100 as well. Alternatively, one or more of these components, in particular, the compressor and/or the condenser, may be located outside cabinet 100, for example in a machine room or on the outside/on the roof of a building (not shown) housing the cabinet 100.

Further, the bottom airflow zone 108-1 (first section) of duct 108 may act as a return air duct that may extend substantially along a horizontal axis and is formed below the lowest shelf of cabinet 100. The bottom airflow zone 108-1 or the rear airflow zone 108-2 may house the fan 112 that may be configured to suck air from the conservation space 106 through a return air opening located at the bottom of the conservation space 106 into the bottom airflow zone 108-1 and deliver the received air to the evaporator/heat exchanger 110 where it is cooled. The return air opening may be covered by RAG 114-2 which may prevent the products, packaging or spillage from falling into duct 108 or bottom airflow zone 108-1.

Cooled air leaving the evaporator/heat exchanger 110 may be delivered to flow vertically through the rear airflow zone 108-2 along the rear wall of cabinet 100. The vertical cold air duct (rear airflow zone 108-2) provided with the perforated wall panels 116 having openings may allow cold air to flow from the vertical cold air duct (rear airflow zone 108-2) into the conservation space 106.

The top airflow zone 108-3 may be fluidly connected with an upper end of the rear airflow zone 108-2 in order to deliver cold air from the rear airflow zone 108-2 to the front side of the conservation space 106. A front end of the top airflow zone 108-3 may be provided with the DAG 114-1 that may discharge cold air from the top airflow zone 108-3 into an upper front area of conservation space 106. The cold air that is discharged through the DAG 114-1 into the upper front area of the conservation space 106 may provide a flow of cold air, creating a cold air curtain 118 flowing substantially along the back of the doors and/or front of the shelves 104 from the top to the bottom of the conservation space 106.

In one or more embodiments, as shown in FIG. 2, cabinet 100 may be a vertical refrigerated display cabinet 100 with flat doors. Shelves 104 may extend between the side walls of case 102 with the front end of the shelves 104 in line with each other, thereby forming a conservation space 106 to support and store products therewithin. Further, multiple flat glass doors or transparent doors 202 (collectively referred to as vertical doors, herein) may be movably coupled to the front of case 102 in a vertical orientation, which may be adapted to move between an open position and a closed position. The vertical door 202 may be provided with at least one handle 204 to allow the user to slide or rotate door 202 to open or close cabinet 100.

In one or more embodiments, as shown in FIG. 3, cabinet 100 may be a semi-vertical refrigerated display cabinet 100 with flat doors is disclosed. Shelves 104 may extend between the side walls of case 102 with a front end of shelves 104 extending in a step-wise manner from top to bottom of cabinet 100, thereby forming a conservation space 106 to support and store products therewithin. Further, multiple flat glass doors 302 may be movably coupled to the front of case 102 in an inclined orientation from a vertical axis, which may be adapted to move between an open position and a closed position. The inclined door 302 may be provided with at least one handle 304 to allow the user to slide or rotate door 302 to open or close cabinet 100.

In one or more embodiments, as shown in FIG. 4, cabinet 100 may be a semi-vertical refrigerated display cabinet 100 with curved doors is disclosed. Shelves 104 may extend between the side walls of case 102 with a front end of shelves 104 extending in a step-wise manner from top to bottom of cabinet 100, thereby forming a conservation space 106 to support and store products therewithin. Further, multiple curved doors 402, in particular, curved glass doors or transparent doors (collectively referred to as curved doors 402, herein) may be slidably coupled to the front of case 102, which may be adapted to move between an open position and a closed position. The curved door 402 may be provided with at least one handle 404 to allow the user to slide the curved door 402 to open or close cabinet 100.

Further, in one or more embodiments, (not shown) channels (or brackets or guide rails) may be provided in front of case 102, which may extend horizontally along the top front end, and bottom front end of case 102. The channels may be provided with ball bearings and the top and bottom sides of the glass doors (202, 302, 402) may be slidably configured in the channels on the top front end, and bottom front end of case 102. Further, the handle (204, 304, 404) may be provided on one of the sides of the glass door (202, 302, 402) to allow users to open or close cabinet 100 as required.

Those skilled in the art would appreciate that as the microchannel heat exchanger 110 is installed on the rear airflow zone 108-2 on the back side of the cabinet 100, the length of the headers 110-A, 110-B may be kept smaller and the face area of the heat exchanger 110 may also be increased compared to existing cabinet designs where the heat exchanger is installed within a bottom airflow zone of the cabinet. As a result, the refrigerant consumption of the microchannel heat exchanger 110 may be reduced and the refrigerant distribution within the flat microchannel tubes 110-C may also be improved compared to existing cabinet designs where the heat exchanger is installed within the bottom airflow zone of the cabinet and involving substantially longer headers. In addition, the use of flat microchannel tubes 110-C in this cabinet 100 may provide frost-free operation due to their good heat transfer performance compared to existing round tube plate fin heat exchangers.

Moreover, as the flat microchannel tubes 110-C in this cabinet 100 are inclined at least by an angle Alpha ($\alpha$) of 10° to 15° to a horizontal plane, the inclined flat microchannel tubes 110-C may enable automated draining of any condensate formed towards the bottom of the rear airflow zone 108-2 for further removal or extraction, irrespective of the orientation of the headers 110-A, 110-B, thereby increasing the cooling capacity and reducing the pressure drop in the microchannel heat exchanger 110 compared to existing cabinet designs where the flat microchannel tubes are oriented horizontally (0° to the horizontal plane) within the airflow zone which generally lead to condensate accumulation in fins or gaps provided between adjacent flat tubes.

Thus, this invention overcomes the limitations, shortcomings, and drawbacks associated with existing cabinets by providing a compact, improved, and efficient refrigerated cabinet that has improved cooling performance with the frost-free operation and reduced air pressure drop.

While the subject disclosure has been described with reference to exemplary embodiments, it will be understood by those skilled in the art that various changes may be made and equivalents may be substituted for elements thereof without departing from the scope of the subject disclosure as defined by the appended claims. Modifications may be made to adopt a particular situation or material to the teachings of the subject disclosure without departing from the scope thereof. Therefore, it is intended that the invention not be limited to the particular embodiment disclosed, but that the subject disclosure includes all embodiments falling within the scope of the subject disclosure as defined by the appended claims.

In interpreting the specification, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

The invention claimed is:

1. A refrigerated display cabinet comprising:

a case comprising one or more shelves disposed between side walls of the case to form a conservation space to support and store one or more products therewithin;

a duct extending from a bottom front side of the cabinet to a top front side of the cabinet via a rear side of the cabinet; and at least one heat exchanger comprising a first header disposed at a left side of a rear airflow zone and a second header disposed at a right side of the rear airflow zone, the first and second headers extending longitudinally between a front end and a rear end of a rear airflow zone, the at least one heat exchanger comprising a plurality of flat microchannel tubes which fluidically connect the first header and the second header, wherein the at least one heat exchanger is disposed within the duct on the rear side of the cabinet with the plurality of flat microchannel tubes inclined at a first predefined angle with respect to a horizontal plane such that the headers on both sides of the flat microchannel tubes are at different elevations.

2. The refrigerated display cabinet of claim 1, wherein the first predefined angle is of at least 10° to 15° to the horizontal plane.

3. The refrigerated display cabinet of claim 1, wherein the duct comprises:

a bottom airflow zone extending along the bottom side of the cabinet;

the rear airflow zone upstream of the bottom airflow zone and extending on the rear side of the cabinet; and a top airflow zone upstream of the rear airflow zone and extending along the top side of the cabinet.

4. The refrigerated display cabinet of claim 1, wherein the first header and the second header are oriented parallel to the horizontal plane.

5. The refrigerated display cabinet of claim 1, wherein the first header and the second header are oriented at a second predefined angle from the horizontal plane.

6. The refrigerated display cabinet of claim 1, wherein the at least one heat exchanger comprises a plurality of fins extending between at least some of the plurality of flat microchannel tubes.

7. The refrigerated display cabinet of claim 6, wherein the plurality of fins extending between at least some of the plurality of flat microchannel tubes is louvered such that a louver airflow path is formed between the adjacent louvers.

8. The refrigerated display cabinet of claim 1, wherein the cabinet is any of an open-front type display cabinet, or a door-type display cabinet comprising one or more doors movably coupled to a front end of the case.

9. The refrigerated display cabinet of claim 1, wherein the cabinet comprises at least one fan positioned upstream or downstream of the at least one heat exchanger within the duct, wherein the at least one fan is configured to facilitate the inflow of air within the duct through the bottom front side of the cabinet, pass the received air through the at least one heat exchanger to cool the received air, and pump out the cool air from the top front side of the cabinet, and wherein the cool air pumped out by the top front side of the cabinet is received by the bottom front side of the cabinet such that an aerothermodynamic barrier or air curtain is formed in front of the one or more shelves or behind doors of the cabinet.

10. The refrigerated display cabinet of claim 1, wherein the top front side of the duct is configured with a discharge air grille (DAG) and the bottom front side of the duct is configured with a return air grille (RAG), wherein the DAG and the RAG control the air directivity and facilitate the creation of the air curtain in front of the one or more shelves or behind doors of the cabinet.

11. The refrigerated display cabinet of claim 1, wherein the cabinet comprises a perforated wall panel (PWP) configured with the duct on the rear side of the cabinet, and the PWP is configured to discharge a portion of cool air, passing through the duct, in the conservation space to maintain the predefined temperature therewithin.

12. The refrigerated display cabinet of claim 11, wherein the heat exchanger is disposed within the rear airflow zone such that the heat exchanger remains at least partially below a bottom most shelf among the one or more shelves in order to discharge a portion of the cool air through the air perforated wall panel (PWP) to the conservation space below the bottom most shelf and above the bottom airflow zone.

* * * * *